US005484115A

United States Patent [19]

Wirtz

[11] Patent Number: 5,484,115

[45] Date of Patent: Jan. 16, 1996

[54] TEXTILE MACHINE HAVING MULTIPLE WINDING STATIONS FOR PRODUCING WOUND YARN PACKAGES

[75] Inventor: Ulrich Wirtz, Mönchengladbach, Germany

[73] Assignee: W. Schlafhorst AG & Co., Monchen-Gladbach, Germany

[21] Appl. No.: 335,265

[22] Filed: Nov. 7, 1994

[30] Foreign Application Priority Data

Nov. 11, 1993 [DE] Germany ..... 43 38 552.4

[51] Int. Cl.[6] ..... B65H 54/02; B65H 69/04; B65G 43/00

[52] U.S. Cl. ..... 242/35.5 A; 242/35.6 R; 198/341; 198/358

[58] Field of Search ..... 242/35.5 A, 35.5 R, 242/18 R, 35.6 R, 35.6 E; 198/358, 341; 57/281

[56] References Cited

U.S. PATENT DOCUMENTS 5,056,725 10/1991 Wirtz et al. .
5,056,726 10/1991 Grecksch et al. ..... 242/35.5 A
5,170,954 12/1992 Derichs ..... 242/35.5 A
5,170,955 12/1992 Grecksch et al. ..... 242/35.5 A
5,190,136 3/1993 Grecksch et al. ..... 242/35.5 A X
5,201,405 4/1993 Noshi ..... 242/35.5 A X
5,245,816 9/1993 Mima ..... 242/35.5 A X
5,289,910 3/1994 Kohlen et al. ..... 242/35.5 A X
5,335,776 8/1994 Backhaus .

FOREIGN PATENT DOCUMENTS

3843553A1 7/1990 Germany .
4302763A1 5/1993 Germany .
4142790A1 6/1993 Germany .
4211236A1 10/1993 Germany .

*Primary Examiner*—Daniel P. Stodola
*Assistant Examiner*—Michael R. Mansen
*Attorney, Agent, or Firm*—Shefte, Pinckney & Sawyer

[57] ABSTRACT

A pallet transport system for a textile machine producing wound yarn cheeses, in particular a winding machine, includes transverse transport tracks disposed between a cop supply track and an empty bobbin return track each transverse track having transport elements which are operated by reversible individual drives. The reversible individual drives can be controlled in a defined manner by the winding head computers of the respective winding heads (I, II, . . . , X, etc.) for improved transport of pallets within the transverse transport tracks.

13 Claims, 4 Drawing Sheets

TEXTILE MACHINE HAVING MULTIPLE WINDING STATIONS FOR PRODUCING WOUND YARN PACKAGES

FIELD OF THE INVENTION

The present invention relates to a textile machine having a plurality of winding heads arranged in alignment with one another for producing wound yarn packages, particularly winders wherein cop-wound bobbins are wound into cheeses, and an associated transport system for conveying support pallets on which cops or empty bobbins are carried individually in an upright disposition, wherein the transport system has at least one cop delivery track, at least one empty bobbin return track and several transverse transport tracks connecting the individual winding heads with these delivery and return tracks.

BACKGROUND OF THE INVENTION

A pallet transport system for a textile machine of the type described above is disclosed, for example, in German Patent Publication DE 38 43 554 A1, wherein the pallet transport system has a cop delivery track extending along the rear side of the winding heads to serve as a cop reserve track for supplying yarn cops to the winding heads, and a cop return track extending along the front side of the winding heads for removing from the winding heads the empty bobbins unwound thereat. The cop delivery track and the empty bobbin return track are connected by a plurality of transverse transport tracks each of which extends through a respective winding head.

A pallet transport conveyor extends along the reserve track and is connected to a reversible drive by means of which the conveyor transport direction can be switched alternately at predetermined time intervals. Another pallet transport conveyor extending along the empty bobbin return track, as well as the transport conveyors along the respective transverse transport tracks, can be driven continuously in one direction during operation of the bobbin winding machine.

The propulsion of the transport conveyors of the transverse transport tracks takes place either, as described in German Patent Publication DE 38 43 553 A1, via a geared connection between these transport conveyors and the driven transport conveyors of the empty bobbin return track or, as practiced in actuality, via special drive elements by which one common drive is provided for the respective transverse transport tracks of one machine section.

The length of each of the transverse transport paths is sufficient that one pallet may be disposed in an unwinding position at a blower chamber while two further cop-equipped pallets are disposed in reserve or standby positions, along the transverse transport track.

The empty bobbins of the unwound cops are immediately removed along the respective transverse track in the direction toward the empty bobbin return track by means of the continuously circulating transport conveyor of the transverse transport track. In the process, the cop-equipped pallet standing in the next adjacent reserve position is simultaneously moved into the blower chamber. Subsequently, the continuous movement of the transport conveyor of the transverse transport track causes one of the cop-equipped pallets circulating on the reserve track to be pulled off the reserve track and transported along the transverse track into the reserve position adjacent the blower chamber.

A winding machine with a similarly constructed pallet transport device is also known from German Patent Publication DE 42 11 236 A1. The winding machine has a cop supply track on a higher level and an empty bobbin return track disposed somewhat lower with the supply and return tracks connected via transverse transport tracks. On the entrance side of each transverse transport track is a respective turntable for conveying pallets, the turntables being frictionally connected with the driven conveyor belt of the cop supply track to be continuously turned by it. Cop-equipped pallets are delivered to the cop supply track and are diverted via special guide tracks into the area of the transverse transport tracks to be grasped by the turntables and transferred into the winding positions of the respective winding heads.

One disadvantage of the above described winding machines, among others, is that the conveyors or other transport means of the several transverse transport tracks are driven continuously and in common with one another. It has therefore been proposed to separate the drive elements of the transverse transport tracks.

Such a winding machine with individual drives for the transverse transport tracks is described in German Patent Publication DE 43 02 763 A1. The turntables situated at the entrances to the transverse transport tracks in this case each have a ratchet mechanism and are individually operated via tappet rods of cam disks. However, this arrangement for driving the turntables is relatively expensive because of the extensive mechanical system involved.

SUMMARY OF THE INVENTION

It is according an object of the present invention to provide an improvement of the pallet transport system of textile machines of the type described above.

The present invention is essentially applicable to substantially any textile machine of the type adapted for winding yarn into cheeses, having a plurality of aligned winding heads and a transport system for conveying pallets carrying yarn-wound cops or empty bobbins disposed upright thereon to and from the winding heads, wherein the pallet transport system has at least one cop supply track, at least one empty bobbin return track and plural transport tracks transversely connecting the individual winding heads with the cop supply and bobbin return tracks. In accordance with the present invention, the foregoing object is attained by providing each transverse transport track with at least one movable transport element extending to the cop supply track and an individual means for reversible driving of the transport element.

The employment of reversible individual drives in a simple manner offers the possibility of positively controlling the transport elements of the respective transverse transport tracks individually which provides the advantage during a batch start in a winding machine of enabling directed control of the individual drives, for example, to assure that ail winding heads are equally treated during the start-up phase of the winding machine. Thus, it can be prevented that the winding heads located upstream in the direction of cop transport along the supply track are preferably treated at the expense of the winding heads disposed further downstream (i.e., first supplied with cops before the more downstream winding heads). By the appropriate control of the individual drive elements, it can be prevented that reserve cops are supplied to the upstream winding heads while the winding heads disposed further downstream in the cop transport direction are still inoperative because of a lack of supply of cops.

The reversible individual drives, which can be positively controlled via a control device, also offer advantages at the completion of a yarn batch. For example, a portion of the reserve cops located in standby positions on the transverse transport tracks can be returned to the cop supply track and redistributed by means of the selected control of the respective individual drives of the transverse tracks. In this manner, it becomes possible at the end of a yarn batch to selectively deliver the remaining unwound cops in the transport system to only certain ones of the winding heads so that the cheeses being wound thereat can still be wound with a predetermined length of yarn.

According to the invention, the transport elements of the transverse transport tracks are idle during the process of unwinding each cop and are only actuated by the winding head computer when necessary to remove an empty bobbin and replace it with a full cop. Thus, the present invention offers additional advantages in reducing the wear of the transport elements and the pallets. Furthermore, the reduced running time of the transport elements results in a reduction of the energy use of the transport system.

It is further preferred under the present invention that the control of the individual drives to the transverse tracks is accomplished by means of individual computers or other controllers each specifically associated with one winding head, with each computer being connected with the central control unit of the winding machine. Since these winding head computers are already present at each winding head of many conventional winders and at the time of the empty bobbin/cop exchange are not involved in executing their usual tasks, these winding head computers can carry out this additional job without problems. Thus, control of the reversible individual drives via the respective winding head computers represents an extremely cost efficient solution. No additional control devices, which typically are costly, are required.

In a preferred embodiment, the reversible individual drives for the transverse tracks are embodied either as stepper motors or as brushless d.c. motors. On the one hand, such drive elements are dependable and on the other hand are relatively cost efficient.

The transport element of each transverse transport track preferably comprises a pair of conveyor belts in the preferred embodiment, the two individual conveyor belts being disposed in spaced apart relation whereby the pallets transported on the conveyor belts remain freely accessible from below in the area of the winding head. Each pair of conveyor belts extends into sufficiently close proximity to the supply track to make it possible to transfer a cop-equipped pallet from the supply track to the transverse transport track. The actual transfer of the cop-equipped pallets is further aided by the embodiment of the supply track with a rope belt disposed at a lateral offset from the lengthwise center of the supply track as the means of conveying the pallets, which serves to impose on the pallets a force component in the direction of the entrance ends of the transverse transport tracks to provide very advantageous results when transferring the pallets by means of the pairs of conveyor belts disposed in the transverse transport tracks.

DESCRIPTION OF THE PREFERRED EMBODIMENT

Figure 1:
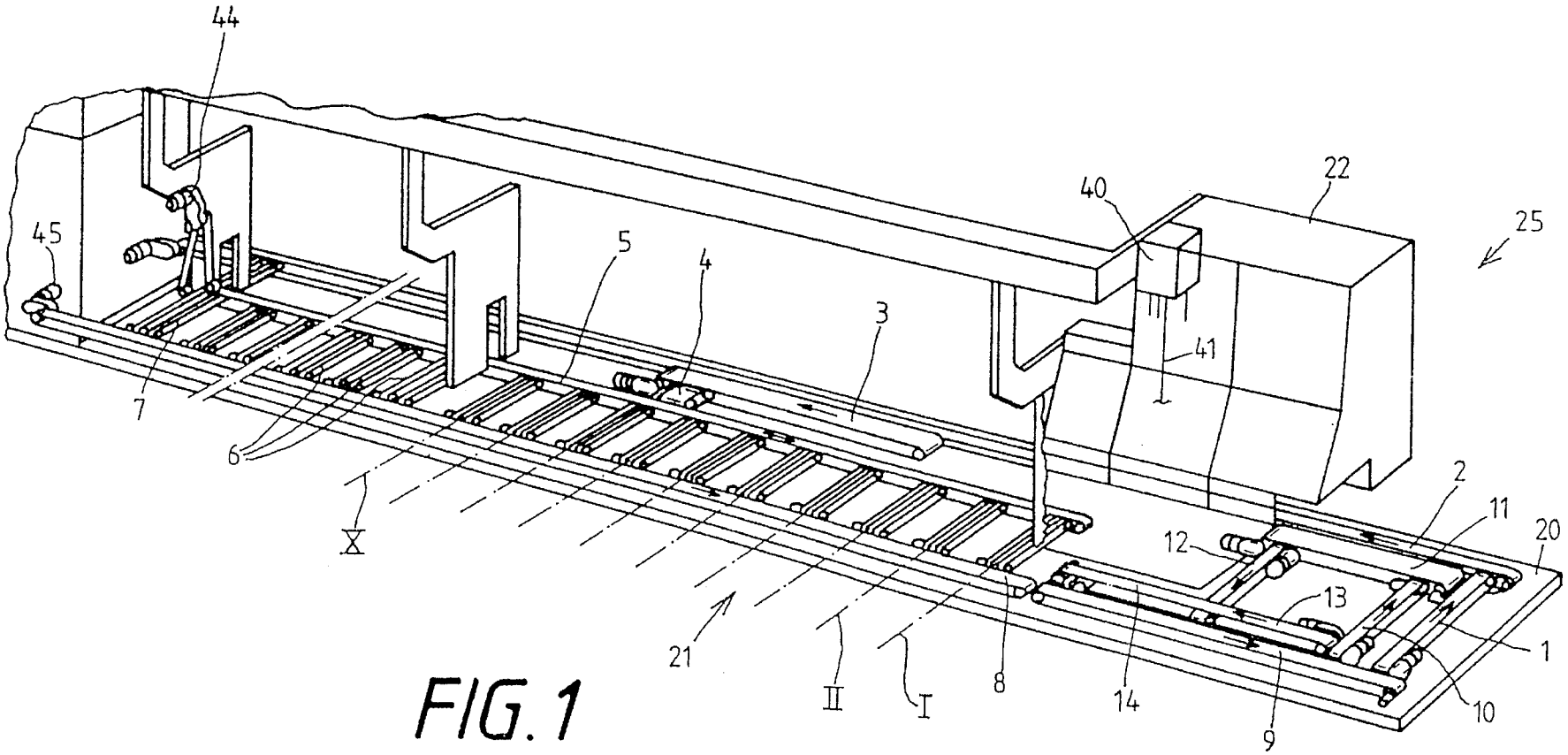
FIG. 1 is a perspective view of a pallet transport system of a textile yarn winding machine (only schematically indicated) in accordance with the present invention.

FIG. 1 shows a perspective view of the pallet transport system 21 of a winding machine 25, which for the sake of clarity has been only schematically indicated. The representation of the winding machine 25 is essentially limited to the power supply and operating unit 22 disposed at one end of the machine, in which a central microprocessor or like control unit 40 is also disposed, as well as to positional indications for the multiple aligned winding heads I, II, . . . , X, of the machine.

A conveyor transport system 21 is arranged on a chassis, indicated as a whole by 20, for delivering yarn-wound cops to, and removing unwound empty bobbin tubes from, the several winding heads of the machine by means of a plurality of support pallets, sometimes referred to as peg trays, on which the respective cops and empty bobbins are carried individually, each in an upright disposition about a peg or post extending upwardly from a flat disk-like base of the associated pallet. The transport system 21 has a plurality of different transport tracks, each preferably in the form of a driven conveyor, the functions of which are briefly explained hereinbelow.

The transport system includes a transfer track 1 which forms an interface of the present transport system 21 with one or more transport systems of textile machines located upstream in the production process, typically ring spinning machines which supply yarn-carrying cops to the winding machine for rewinding into larger yarn packages, such as cheeses.

The transfer of the cops produced on the ring spinning machines from the transport system thereof to the transport system of the winding machine and the return of the unwound bobbin tubes takes place in the area of the transfer track 1 by means of a known form of transfer device (not shown). The cops placed on the pallets which are associated with the winding machine are initially transported onto and along a transport track 2 extending substantially the length of the machine, from which the pallets are diverted onto one or more cop preparation tracks 3 along which are provided cop preparation stations (not shown) operative to locate the reserve windings formed by the leading end of yarn on each cop and form a winding of the yarn about the nose of the cop in a known manner. Subsequently the cops are transferred by a removal track 4 onto a cop supply track 5, which acts as a cop reserve track. The cop supply track 5 extends alongside the several winding heads of the machine and a plurality of transport tracks 6, each associated with a respective winding head of the machine, extend transversely from the supply track 5 in parallel with one another through the respective winding heads. The cop supply track 5 is driven through a switching device to repetitively reverse traveling directions of its conveyor, whereby the cops positioned on the pallets are transported by and presented to the entrances of the transverse transport tracks 6 which travel away from the supply track 5. Preferably, each of the transverse transport tracks 6 receive three pallets carrying cops, a first pallet being advanced by the transverse track 6 into a winding position inside a blower chamber 17 (not represented in FIG. 1; see FIGS. 2–4) of the respective winding head I, II, . . . , or X, etc., while two following pallets rest on the transverse track 6 in reserve or standby positions upstream of the blower chamber.

Once each cop is unwound of its yarn at the respective blower chamber 17, the empty bobbin tube and the supporting pallet are released by the blower chamber 17 and transported by the transverse track 6 to a return track 8 extending along the opposite side of the winding heads in parallel to the supply track 5 and therefrom to a distributing track 9 for return to the transfer track 1, from which the empty tubes are returned by means of a transfer device to the transport system of the ring spinning machines, as previously indicated.

Pallets carrying cops which could not be processed by the preparation devices disposed along the preparation track 3 are conveyed directly to the return track 8 via a transverse connector track 7 and transported by the return track 8 to the distribution track 9. The distribution track 9 conveys pallets carrying bobbins with a small remainder of yarn, any remaining cops and any cops whose reserve yarn end could not be prepared to a conveyor 10, from which the pallets are distributed onto a preparation track 11 to a station for preparing the leading yarn end of any cop or any bobbin having a usable amount of residual unwound yarn, therefrom onto a repetition track 12 along which a special preparation station is arranged to repeat the end preparation process if necessary, or onto a bobbin cleaning track 13 for removing any unusable residual yarn, depending on the particular condition of the respective bobbin or cop on each pallet. Cops which cannot be prepared even in the special preparation station along the repetition track 12 are transferred onto a manual preparation track 14.

Figure 2:
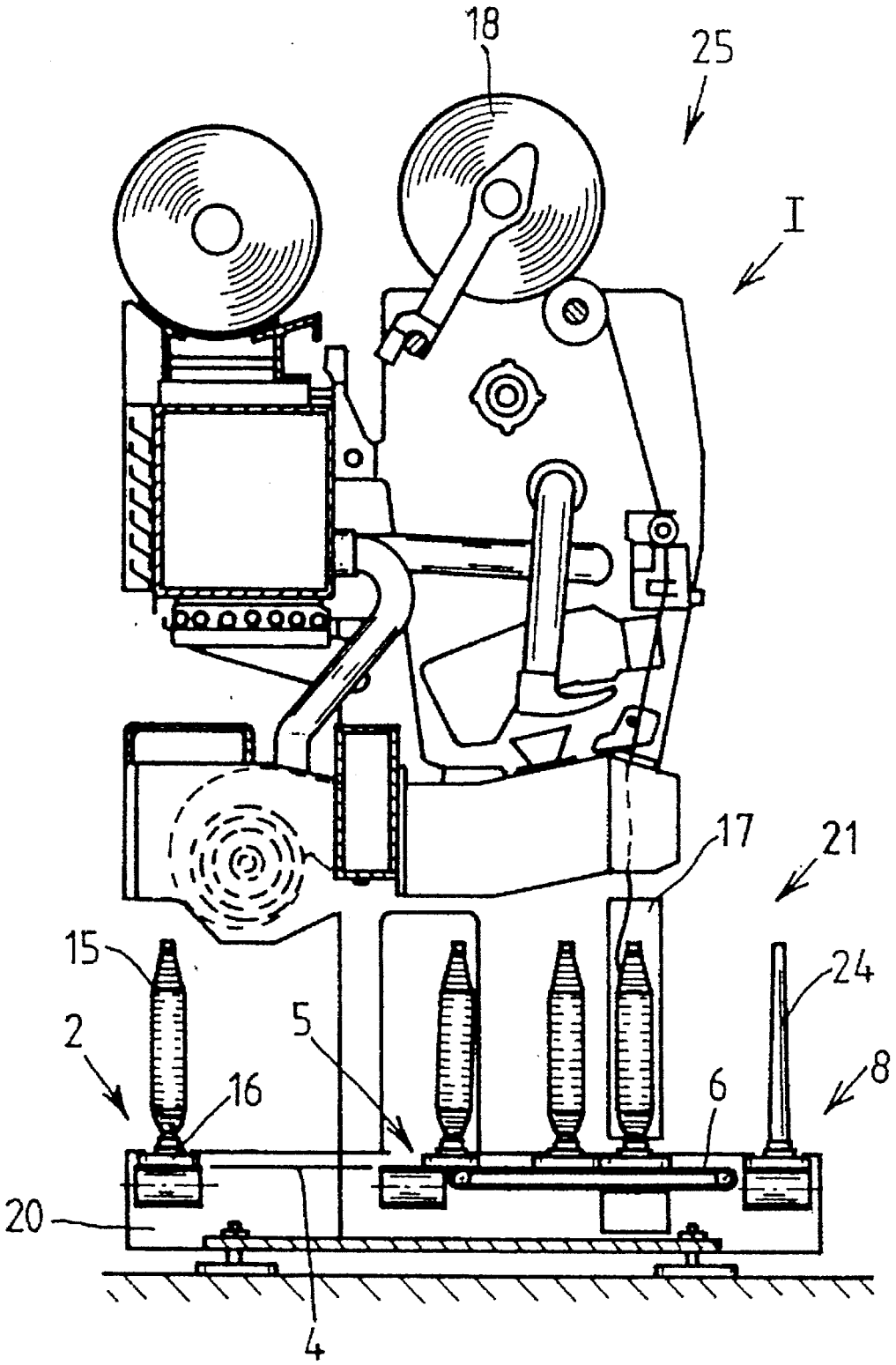
FIG. 2 is a side elevational view of a representative winding head of the winding machine of FIG. 1 with the associated pallet transport system.

FIG. 2 shows a side view of one of the winding heads I, II, . . . , X, of the winding machine 25 as well as the pallet transport system 21. The basic structural design and the function of the winding heads is known and therefore need not be described in detail herein. The lengthwise transport track 2 by means of which the winding machine 25 is supplied with cops 15 is indicated at the rearward side of the winding heads, and, as already indicated above, prepared cops 15 are transferred from the transport track 2 onto the cop supply or reserve track 5, also disposed behind the winding heads, via the removal track 4. The cop supply track 5 has a reversible drive element 44 (FIG. 1), which operates an associated transport means, for example a conveyor belt or a rope belt 26 (FIG. 3), to cause the cop-equipped pallets 16 on the cop supply track 5 to continuously circulate back and forth along the supply track 5 past the entrance areas of the transverse transport tracks 6.

Figure 3:
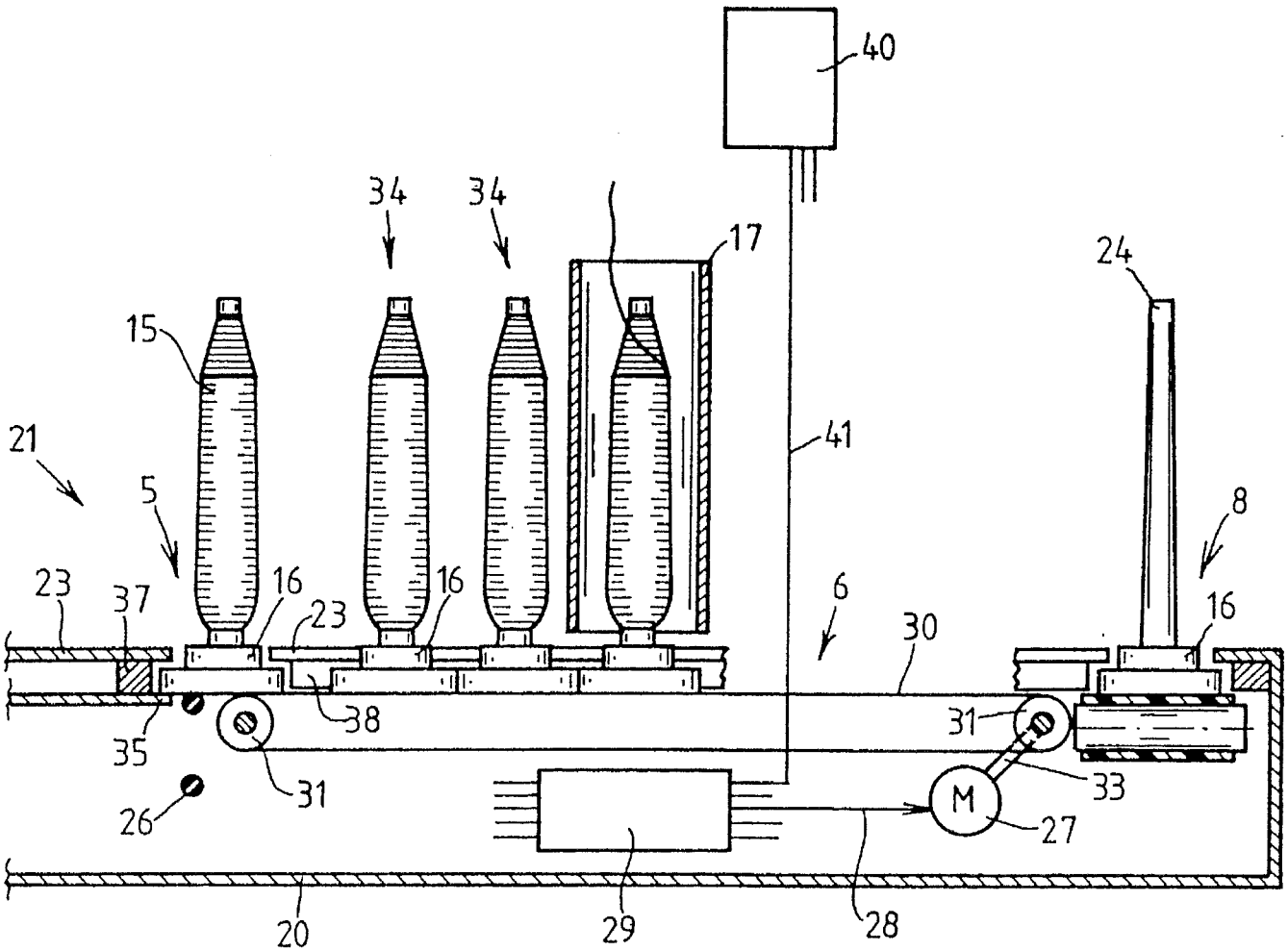
FIG. 3 is an enlarged side elevational view of one representative transverse transport track associated with a winding head of the winding machine of FIG. 1, taken along the section line III—III of FIG. 4.
Figure 4:
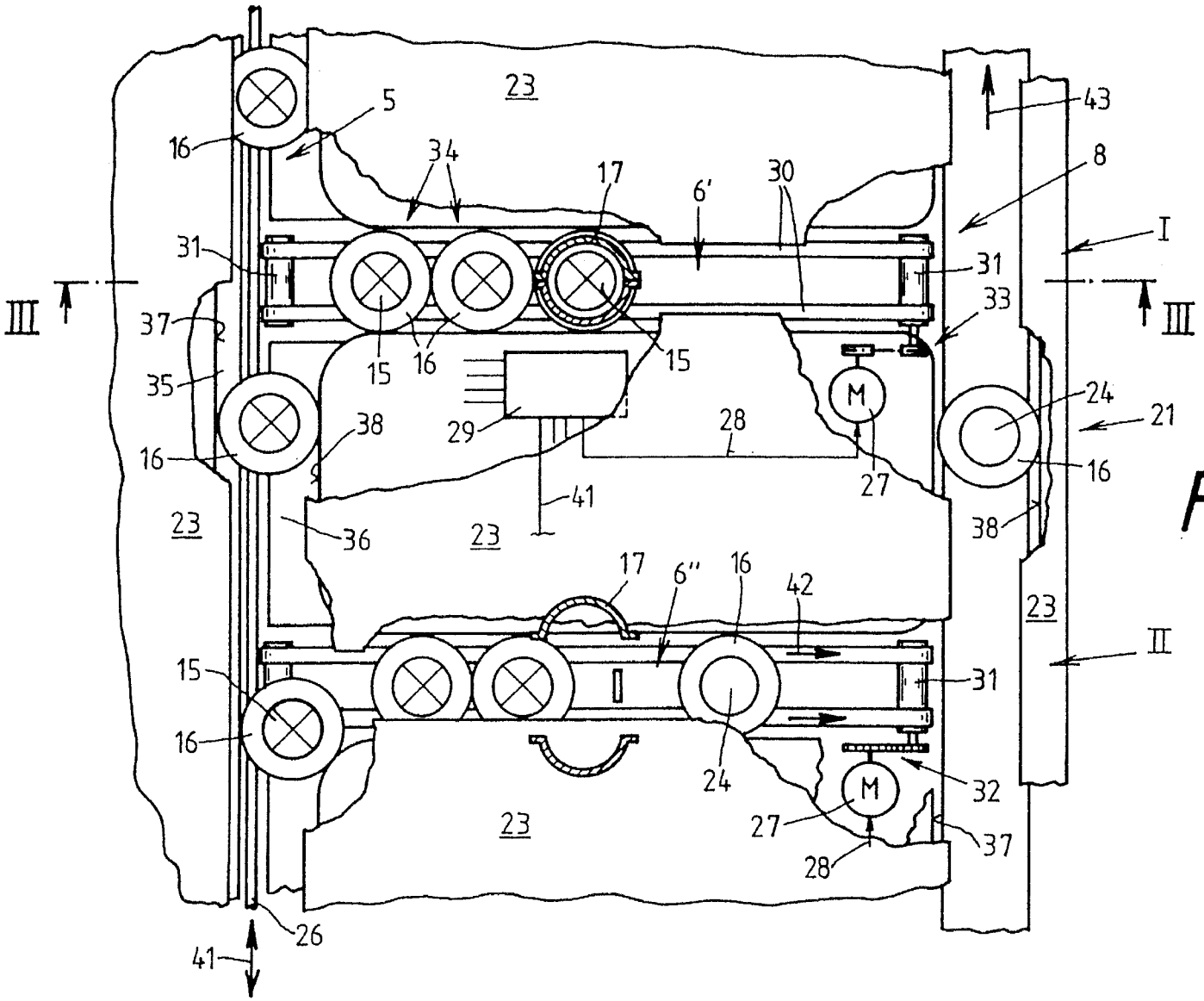
FIG. 4 is a top plan view of a portion of the pallet transport system of FIG. 1 in accordance with the present invention, depicting two transverse transport tracks associated with respective winding heads.

As shown in FIGS. 3 and 4 in particular, each transport track 6 is comprised of transport elements 30 in the form of a pair of parallel spaced-apart conveyor belts trained about the ends of opposed reversing rollers 31 one of which is operated by a reversible individual drive motor or like drive element 27. By way of example, the individual drive elements 27 for the respective conveyor belt pairs may be connected with their respective drive rollers via a gear arrangement 32 or another power transfer device 33 and the drive elements 27 are operated via respective control lines 28 connected with the associated winding head computer 29.

The operation of the present invention may best be understood with reference to FIG. 4. The winding head I depicts the operational condition prevailing during the process of rewinding yarn from a cop 15 at the winding head onto a larger cheese-type yarn package 18 (see FIG. 2). The cop 15 is positioned in the blower chamber 17 while being unwound and rewound to form the cheese 18. Two further cops 15 are positioned on pallets 16 in the reserve and standby position 34 adjacent the blower chamber 17. During this operation, the transport belts 30 of the transverse transport track 6' are stopped, while cop-equipped pallets 16 continuously circulate back and forth along the cop supply track 5 behind the transverse transport track 6'. The rope conveyor 26 is used as the means of reversing the pallet transport direction along the cop supply track 5 under the operation of a reversible drive element 44, as indicated by the directional arrow 41. In the process the pallets 16 move along slide rails 35, 36 while being laterally retained by guide bars 37,38 with the upper side of the base of the cop-equipped pallet 16 being covered, at least partially, by metal cover panels 23.

Following the completion of the unwinding process, the blower chamber 17 is opened and the pallet 16 carrying the empty bobbin 24 is transported via the transverse track belts 30 in the direction of the bobbin return track 8 as indicated at the winding head II. For such purpose, the reversible drive element 27, as controlled by the associated winding head computer 29 via the control line 28, moves the conveyor belts 30 in the direction of the arrows 42. At the return track 8, the pallet 16 carrying the empty bobbin 24 is transferred onto the empty bobbin return track 8, the transport conveyor of which is driven in the direction of the arrow 43 by a drive element 45. At the same time, the first of the two cop-equipped pallets 16 disposed in the standby position 34 moves into the blower chamber 17 and is processed therein in a known manner after the blower chamber has been closed.

Subsequently, the transport elements 30 of the transverse transport track 6" at the winding head II continue to be driven in the direction of the arrows 42 until one of the cop-equipped pallets 16 traveling along the supply track 5 is drawn off the supply track 5 onto the transverse track 6" and moved into the standby position which has become available adjacent the respective winding head II. Thereafter, the respective drive element 27 is deactuated so that the transport elements 30 of the transverse transport track 6" remain motionless until the next cop change process.

Special machine events, such as batch changes, are monitored by the central control unit 40, which is connected with the winding head computer 29 via control lines 41 (see FIG. 1). In such cases, the central control unit 40 controls the reversible individual drive elements 27 via the winding head computers 29 in accordance with a predetermined program stored therein.

For example, during a batch start the reversible individual drive elements 27 are individually controlled so that the individual winding heads I, II, . . . , X, etc. are first supplied with cops 15 only in accordance with their immediate requirements. In this way, it is assured that the reserve positions 34 of the several transverse transport tracks 6 are only replenished when no immediate cop demand exists at the remaining winding heads I, II, . . . , X, etc., of the winding machine 25.

Likewise, toward the end of the batch, the amount of yarn present in the form of cop-equipped pallets 16 at any moment in the bobbin transport system 21 is concentrated at particular selected winding heads as determined by the central control unit 40, so that it is possible to produce cheeses of a desired yarn length at least at these selected winding heads. For this reason, the cop-equipped pallets 16 in the standby positions of other non-selected winding heads are conveyed back to the cop supply track 5 by switching of the associated reversible individual drive elements 27 and are subsequently distributed to the selected winding heads.

As a whole, it will therefore be understood that the use of reversible individual drive elements for the transverse transport tracks results in a further improvement in the bobbin transport systems of textile machines which produce cheeses.

It will therefore be readily understood by those persons skilled in the art that the present invention is susceptible of broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

I claim:

1. A textile machine for winding yarn into cheeses, having a plurality of aligned winding heads and a transport system for conveying pallets carrying yarn-wound cops and empty bobbins disposed upright thereon to and from the winding heads, the pallet transport system having at least one cop supply track, at least one empty bobbin return track and a plurality of transport tracks transversely connecting the individual winding heads with the cop supply and bobbin return tracks, each of the plurality of transverse transport tracks having at least one movable transport element extending to the cop supply track for transporting the pallets along said transverse transport track and an individual means for reversible driving of the at least one movable transport element.

2. A textile machine for producing cheeses in accordance with claim 1, and wherein each of the plurality of transverse transport tracks further comprises a control device for positively controlling the reversible individual driving means in respect to direction, distance and time of travel.

3. A textile machine for producing cheeses in accordance with claim 2, and wherein the textile machine further comprises a central control unit connected with the control devices for the reversible individual driving means for control thereof.

4. A textile machine for producing cheeses in accordance with claim 3, wherein the central control unit stores a control program to operate the reversible individual driving means during a start of a batch change to initially supply the winding heads with cops in accordance with their immediate cop requirements.

5. A textile machine for producing cheeses in accordance with claim 4, wherein each of the plurality of transverse transport tracks includes at least one reserve position for a cop awaiting delivery to the respective winding head, and the control program is further operative during a starting period of a batch change to operate the reversible individual driving means to supply the reserve positions of the transverse transport tracks with cops only after no immediate cop requirements exist in the winding heads of the winding machine.

6. A textile machine for producing cheeses in accordance with claim 3, wherein the central control unit stores a control program to operate the reversible individual driving means during an ending period of a batch change to supply cops to selected winding heads.

7. A textile machine for producing cheeses in accordance with claim 6, wherein the control program is further operative to control the reversible individual driving means associated with the non-selected winding heads to return cop-equipped pallets disposed in their reserve position to the cop supply track by reversing the direction of drive of the reversible individual driving means.

8. A textile machine for producing cheeses in accordance with claim 1, wherein the reversible individual driving means comprise stepper motors.

9. A textile machine for producing cheeses in accordance with claim 1, wherein the reversible individual driving means comprise brushless d.c. motors.

10. A textile machine for producing cheeses in accordance with claim 1, wherein the at least one movable transport element of each transverse transport track comprises a pair of individual conveyor belts which are spaced apart from each other.

11. A textile machine for producing cheeses in accordance with claim 1, wherein the at least one cop supply track comprises a rope conveyor for transporting pallets thereal-ong.

12. A textile machine for producing cheeses in accordance with claim 11, wherein the cop supply track comprises means for reversible driving of the rope conveyor.

13. A textile machine for producing cheeses in accordance with claim 11, wherein the rope conveyor is disposed at a lateral offset from the longitudinal center of the cop supply track.

* * * * *